US005722857A

United States Patent [19]

Saito et al.

[11] Patent Number: 5,722,857

[45] Date of Patent: Mar. 3, 1998

[54] CONNECTOR EQUIPPED WITH INSERTION DETECTING MEMBER FOR TERMINAL METAL PARTS

[75] Inventors: Hitoshi Saito; Kazuto Ohtaka; Hitoshi Sakai; Hisashi Hanazaki, all of Shizuoka, Japan

[73] Assignee: Yazaki Corporation, Tokyo, Japan

[21] Appl. No.: 597,288

[22] Filed: Feb. 6, 1996

[30] Foreign Application Priority Data

Feb. 6, 1995 [JP] Japan ..... 7-017809
Jan. 10, 1996 [JP] Japan ..... 8-002377

[51] Int. Cl.[6] ..... H01R 13/40

[52] U.S. Cl. ..... 439/595; 439/752

[58] Field of Search ..... 439/595, 744, 439/752

[56] References Cited

U.S. PATENT DOCUMENTS 5,071,369 12/1991 Denlinger et al. ..... 439/595
5,292,261 3/1994 Hirano et al. ..... 439/595

FOREIGN PATENT DOCUMENTS 4-55765 5/1992 Japan .

*Primary Examiner*—Neil Abrams
*Assistant Examiner*—T. C. Patel
*Attorney, Agent, or Firm*—Armstrong, Westerman, Hattori, McLeland & Naughton

[57] ABSTRACT

There are provided a resilient engaging piece to the terminal metal part provided through the resilient displacement permissible space opposite to the terminal accommodating cavity formed at a connector body portion of the connector, and the insertion detecting body corresponding to the resilient displacement permissible space at the main frame portion of the insertion detecting member for terminal metal parts and a pair of manipulating pieces each at opposite sides thereof. The insertion detecting member for terminal metal parts is caused to move freely to enable the main frame portion thereof to come into contact with the inside wall surface of the hood portion. The pair of manipulating pieces are exposed at both sides of the housing body portion through the window of the hood portion at the provisional engaging position, and the insertion detecting body can be moved to enter into the resilient displacement permissible space at the formal engaging position.

7 Claims, 10 Drawing Sheets

CONNECTOR EQUIPPED WITH INSERTION DETECTING MEMBER FOR TERMINAL METAL PARTS

BACKGROUND OF THE INVENTION

1. Field of the Invention

The present invention relates to a connector equipped with an insertion detecting member for terminal metal parts which is capable of detecting incomplete insertion of the terminal metal parts.

2. Description of the Prior Art

In FIGS. 16 and 17, (a) is a female type connector housing with a hood portion (a1) in front thereof, (b) is an insertion detecting member for a terminal metal parts. The insertion detecting member (b) is provided with an introducing portion (b1) divided into two parts followed by a detecting portion (b2). An insertion guide portion (b3) is formed at both sides of the detecting portion (b2) and a downturned arch-shaped manipulating portion (b4) depends from the lower part of the introducing portion (b1).

A pair of guide grooves (d), (d) are formed at opposite positions of an inside wall of hood portion (a1) of the female type connector housing (a). The insertion detecting member (b) is permitted to pressed into the hood portion (a1) while the insertion guide portions (b3), (b3) are engaged with the guide grooves (d), (d). This causes the manipulating portion (b4) to protrude toward the outside from the window (e) formed from the hood portion (a1) to a housing body (a2) (referring to FIGS. 17 and 18).

FIG. 18 shows a provisional engagement condition of the insertion detecting member (b). In this condition a provisional engaging projection (f) engages with a rear end of a connecting portion (g) of the female connector housing (a). In the provisional engagement condition, the terminal metal part (C) is inserted into a terminal accommodating cavity (a3) from the rear while bending downward a resilient engaging piece (h) through displacement permissible space (i). After complete insertion of the terminal metal part (C), the engaging projection (h1) of the resilient engaging piece (h) is restored to its original state wherein it is inserted into an engaging hole in the terminal metal part (C). In this condition, the insertion detecting member (b) is caused to be pressed into the female connector housing (a) by grasping the manipulating portion (b4). This causes the detecting portion (b2) to positioned into the displacement permissible space (i). Thus, the final engaging projection (j) to connects to the rear end of the connecting portion (g), and the insertion detecting member (b) is caused to be fixed in the final engaging condition as shown in FIG. 19.

As shown in FIG. 20, when the terminal metal part (C) is inserted incompletely, becomes impossible that it the insertion detecting member (b) can move toward the final engaging position, since the resilient engaging piece (h), which is forced to be deformed by the terminal metal part (C), is not deformed and is positioned in the displacement permissible space (i) as a result thereof. Thus, it becomes possible to detect that the terminal metal part (C) is inserted incompletely.

In the above described prior art, since the guide grooves (d), (d) are formed an the inside wall of the hood portion (a1), the hood portion (a1) is prone to deform. If the side of the body and substance of the surroundings of the guide grooves (d), (d) are expanded to prevent this deformation, they create the disadvantage that the external shape dimension of the hood portion becomes large. Further since the arch-shaped manipulating portion (b4) is caused to protrude toward the outside of the female connector housing (a), a large notching for forming the window (e) from the hood portion (a1) to the housing body portion (a2) becomes necessary. Furthermore, since the insertion detecting member (b) is caused to engage with the guide groove (d) to move to the final engaging position by the manipulating portion (b4) protruded at one end of the detecting member (b), a scuffing is prone to be generated at the insertion detecting member (b) when the insertion detecting member (b) moved. Thus, a disadvantage is created in that movement can not be performed smoothly.

SUMMARY OF THE INVENTION

In view of the foregoing, it is an object of the present invention to provide a connector equipped with an insertion detecting member for terminal metal parts in which the strength of the connector housing is not reduced even if the insertion detecting member is provided, and the insertion detecting member is capable of moving smoothly.

According to one aspect of the present invention, for achieving the above-described object, there is provided a connector having an insertion detecting member for terminal metal parts, which connector has a hood portion in front thereof, an insertion detecting member for terminal metal parts provided movably from a provisional engaging position to a final engaging position within the hood portion, a resilient engaging piece for the terminal metal part being provided for a terminal accommodating cavity formed at a housing body portion of the connector, the resilient engaging piece existing between the terminal accommodating cavity and a resilient displacement permissible space opposite to the terminal accommodating cavity, and an insertion detecting body corresponding to the resilient displacement permissible space and a pair of manipulating pieces on both sides thereof being provided at a main frame portion of the insertion detecting member for terminal metal part, wherein the insertion detecting member for terminal metal part causes the main frame portion to come into contact with an inside wall surface of the hood portion, with the insertion detecting member for terminal metal part moved freely, the pair of manipulating pieces are exposing at both sides of the housing body portion from a window of the hood portion at the provisional engaging position, the insertion detecting body enters into the resilient displacement permissible space at the final engaging position.

As stated above, the connector equipped with the insertion detecting member for terminal metal parts according to the invention in which the insertion detecting member for terminal metal part is permitted to move by pulling one pair of the manipulating pieces exposed to the side direction of the housing body portion from the provisional engaging position to the final engaging position, at this time if there exists a terminal metal part with an incomplete insertion, since the insertion detecting body comes into contact with the resilient engaging piece positioned into the resilient displacement permissible space, the insertion detecting member for terminal metal part is not capable of being moved.

Next, the final engaging projection **9*b* is caused to engage with the lock connecting portion 5' by pulling one pair of the manipulating pieces 8 exposed thereby and the insertion detecting member B is caused to proceed to the final engaging portion for the female connector A. In the final engaging portion, the insertion detecting bodies 7 enters into the resilient displacement permissible spaces 4 thereby ensuring that failure of the terminal metal part C to engage with the displacement of the resilient engaging piece 3** is avoided.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

Figure 1:
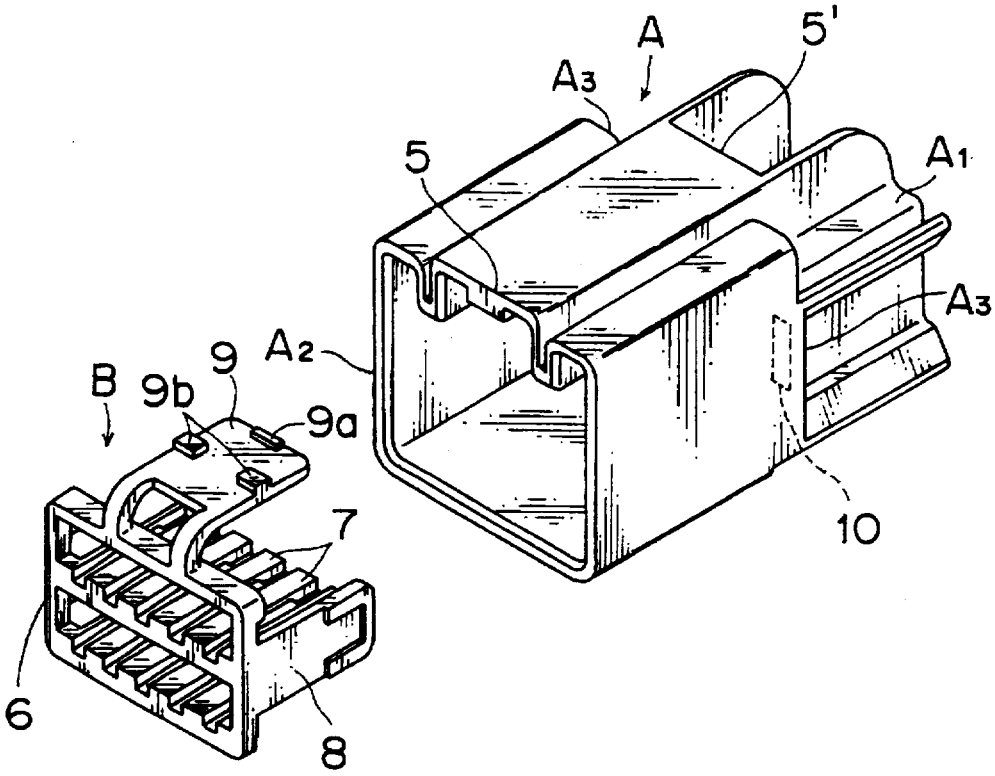
FIG. 1 is a perspective view showing a separated condition between the connector and the insertion detecting member for terminal metal parts of an embodiment according to the present invention.
Figure 2A:
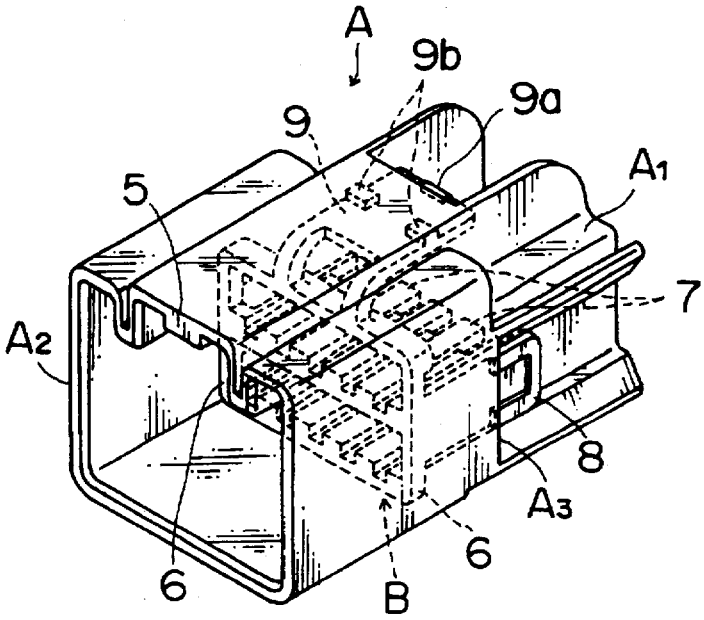
FIG. 2A is a sectional view showing a provisional engaging condition of the insertion detecting member for terminal metal parts within the connector.
Figure 2B:
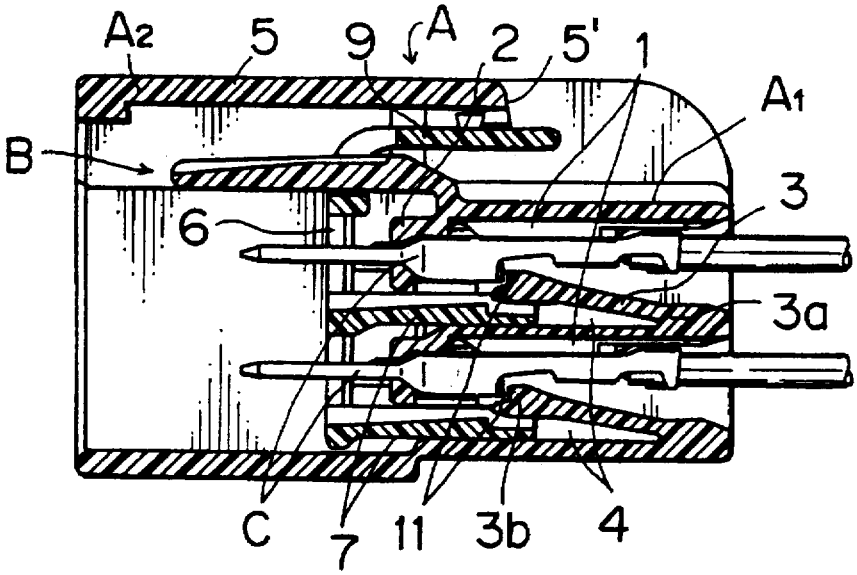
FIG. 2B is a sectional view along an insertion axis direction of FIG. 2A.
Figure 3A:
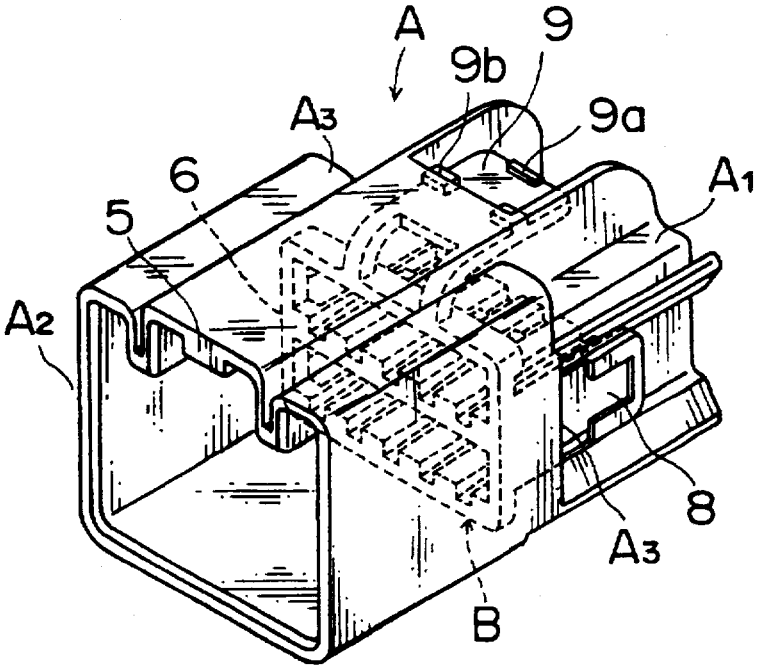
FIG. 3A is a perspective view showing a final engaging condition of the insertion detecting member for terminal metal parts with the connector.
Figure 3B:
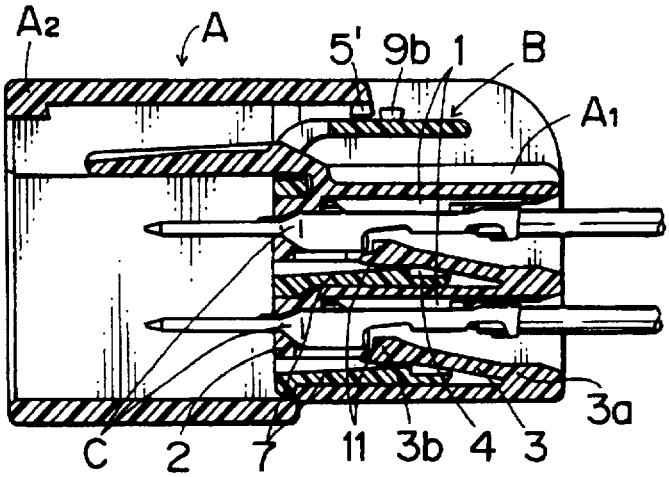
FIG. 3B is a sectional view along the insertion axis direction of FIG. 3A.

A preferred embodiment of the present invention will now be described in detail referring to the accompanying drawings.

In FIGS. 1 to 3(B), A is a female connector, B is an insertion detecting member for terminal metal part.

The female connector A comprises a housing body portion A1 and a hood portion A2 extended through a step portion A3 in front thereof. A plurality of terminal accommodating cavities are provided in the housing body portion A1 in two parallel layers. In each terminal accommodating cavity, a stopper 2 is provided in the front end thereof, and a cantilevered resilient engaging piece 3 extending forward through a supporting base portion **3*a* is provided at a lower portion. An engaging projection 3*b* is provided at a free end portion in the front part of the resilient engaging piece 3. A displacement permissible space 4 is formed on the opposite side of the terminal accommodating cavity 1** below the cantilevered engaging piece.

A connecting frame portion for locking 5 is provided at an upper portion of the hood portion A2. A lock connecting portion 5'0 is formed at a rear end open part of the connecting frame portion for locking 5.

The insertion detecting member for terminal metal parts B has a middle portion of a main frame portion 6 shaped narrow in width in the back-and-forth direction and a plurality of insertion detecting members 7 extending forward corresponding to the resilient displacement permissible space 4 in the lower part thereof. A pair of manipulating pieces 8 extending forward are provided at both sides thereof and a resilient locking arm 9 extending forward is provided in the upper part. The resilient locking arm 9 has a provisional engaging projection **9*a* at forward end, and a final engaging projection 9*b*** at middle portion thereof.

In the above described construction, the insertion detecting member B is inserted into the hood portion A2 while contacting the main frame portion 6 to the interior of the hood portion A2 beforehand. The insertion detecting member is combined with the female connector A at the provisional engaging position in which the provisional engaging projection **9*a* of the resilient locking arm 9 is caused to engage the lock engaging portion 5'. At this time, one pair of manipulating pieces 8 are exposed at the side portion of the housing body portion A1 from the window 10 (referring to FIG. 1) of the step portion A3. (referring to FIG. 2**(A))

The terminal metal part C to insert into the terminal accommodation cavity 1 from the rear direction of the housing body A1. At this time, the terminal metal part C is inserted into the terminal accommodating cavity 1 while deforming the resilient engaging piece 3 into the resilient displacement permissible space 4. After complete insertion of the terminal metal part C, the engaging projection **3*b* of the resilient engaging piece 3 is restored to the original state to engage with the shoulder portion 11 on the terminal metal part C thus to prevent withdrawal of the terminal metal part C. (referring to FIG. 2**(B))

Next, the final engaging projection **9*b* is caused to engage with the lock connecting portion 5' by pulling one pair of the exposed manipulating pieces 8 thereby causing the insertion detecting member B to proceed to the final engaging position for the female connector A. In the final engaging position, the insertion detecting members 7 enters into the resilient displacement permissible spaces 4 thereby ensuring that the terminal metal part C is brought into engagement with the resilient engaging piece 3. (referring to FIG. 3**(B))

In the case of an incomplete insertion condition of the terminal metal part C, since the resilient engaging piece is positioned in the resilient displacement permissible space 4, the insertion detecting member B is not capable of being moved to the final engaging position in that the insertion detecting member 7 cannot enter into the resilient displacement permissible space 4, thereby the incomplete insertion of the terminal metal part C can be detected.

Figure 4:
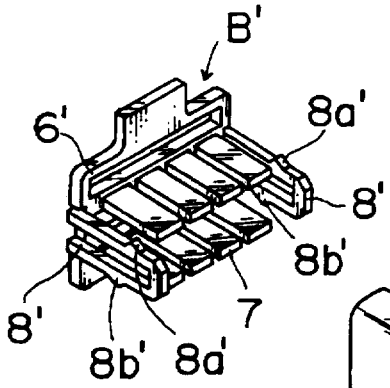
FIG. 4 is a perspective view showing a separated condition between the connector and the insertion detecting member for terminal metal parts of a second embodiment according to the present invention.
Figure 4:
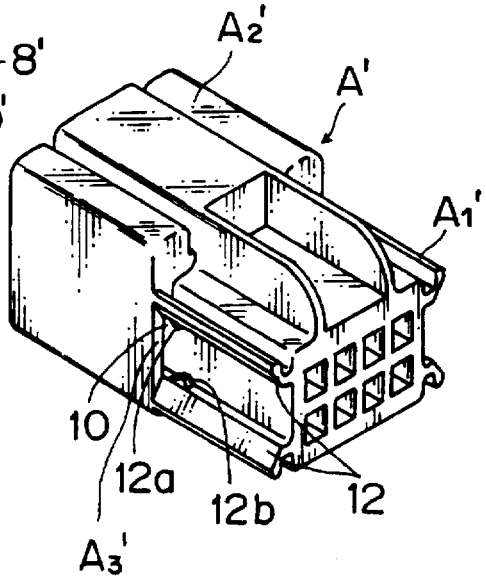
Figure 5:
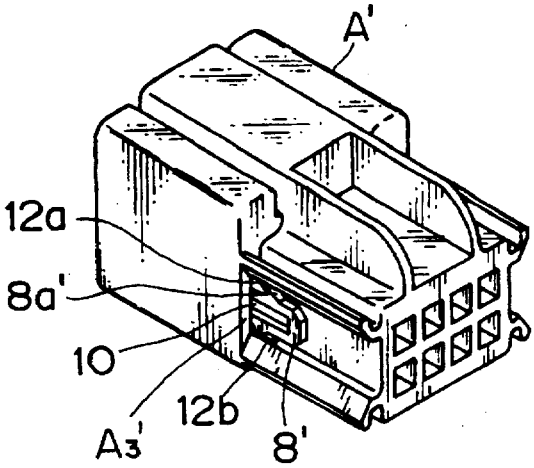
FIG. 5 is a perspective view showing a provisional engaging condition of the members shown in FIG. 4.
Figure 6:
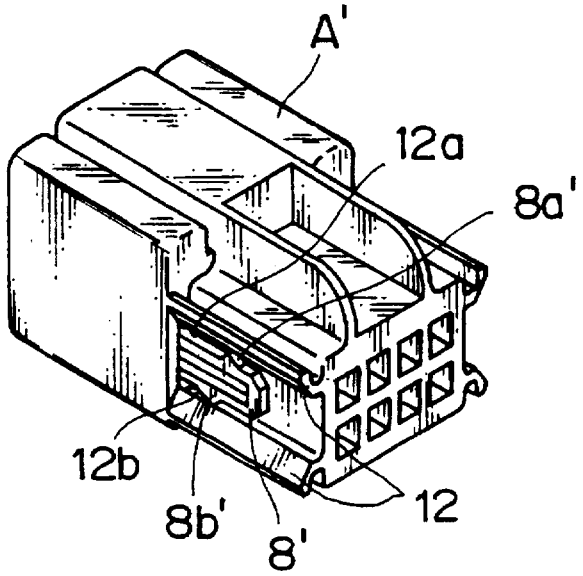
FIG. 6 is a perspective view showing a final engaging condition of the members shown in FIG. 4.
Figure 7:
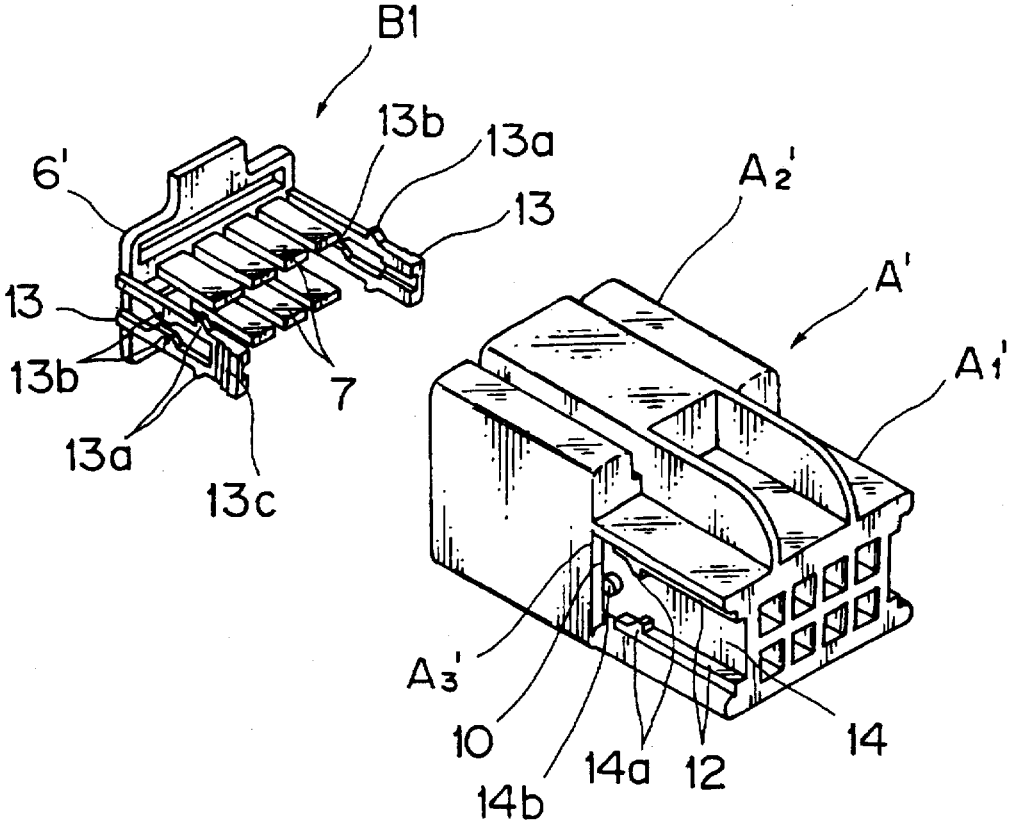
FIG. 7 is a perspective view showing a separated condition between the connector and the insertion detecting member for terminal metal parts of a third embodiment according to the present invention.
Figure 8:
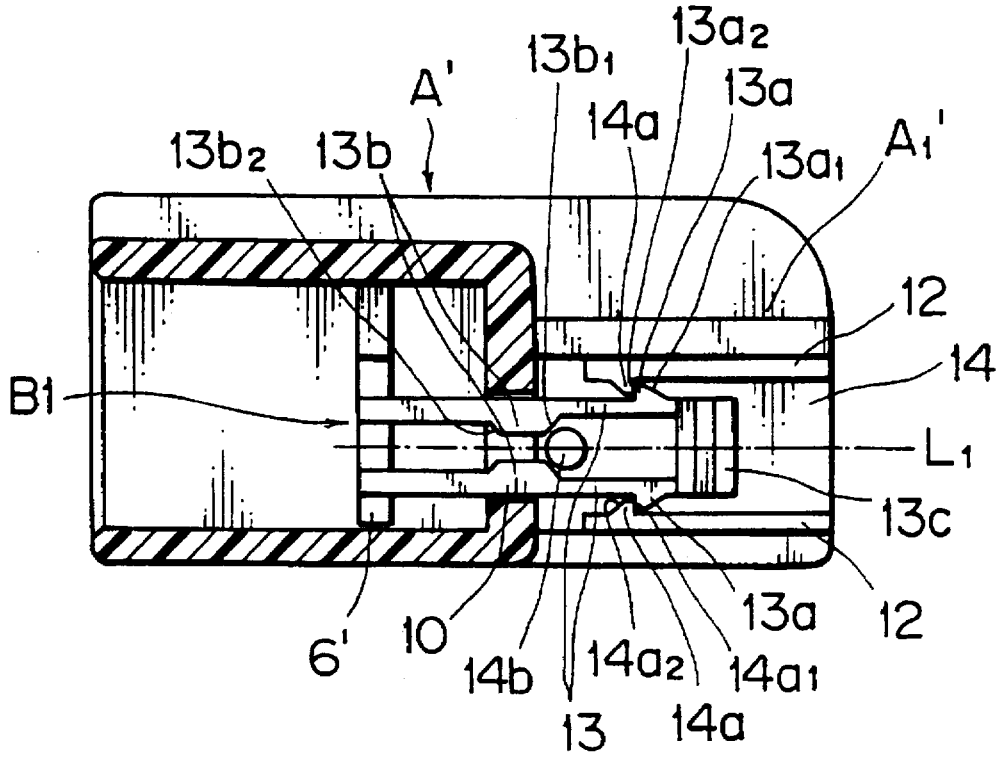
FIG. 8 is a side view showing a provisional engaging condition of the members shown in FIG. 7.
Figure 9:
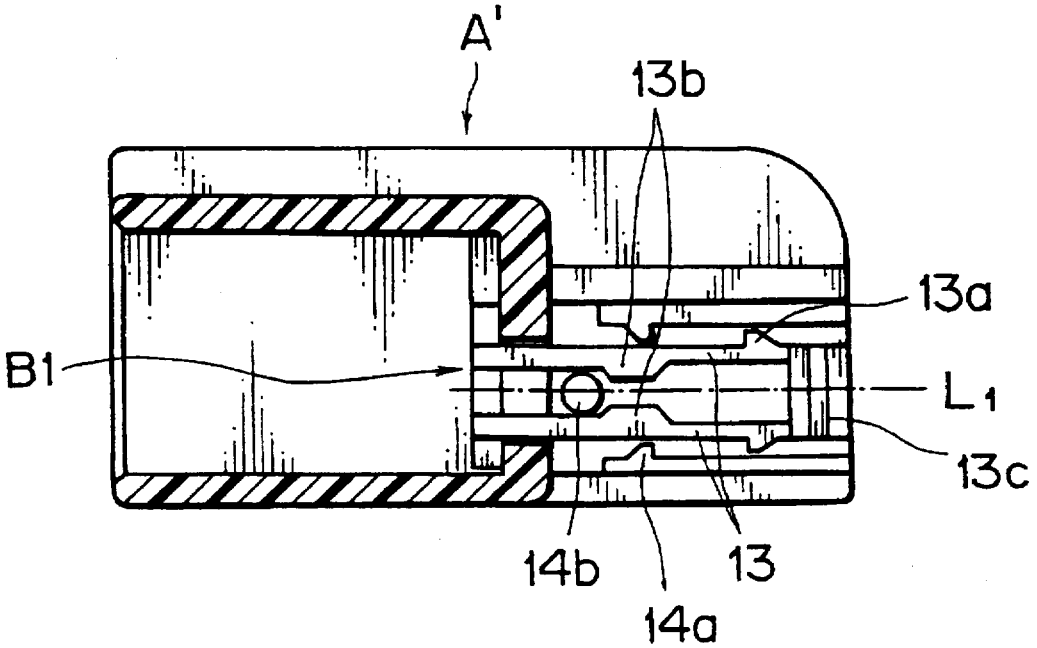
FIG. 9 is a perspective view showing a final engaging condition of the members shown in FIG. 7.

In the construction as shown in FIGS. 4 to 6, a manipulating piece 8' formed as a resilient frame body is provided at both sides of a main frame portion 6' of an insertion detecting member for terminal metal part B', a cone-shaped provisional engaging projection **8*a*' and a final engaging projection 8*b*' are formed at the upper and lower parts of the manipulating pieces 8', a cone-shaped provisional engaging projection 12*a* and a final engaging projection 12*b* are provided protrusively from guide ribs 12** on the side wall outer surface of a housing body A1'.

FIG. 5 shows a joined condition at the provisional engaging position to the female connector A' and the insertion detecting member B', the provisional engaging projection **8*a*' exposed at the side portion of the housing body portion A1' through the window 10 of the step portion A3' from the inside of the hood portion A2' engages with the provisional engaging projection 12*a* formed on the upper guide rib 12**.

The insertion detecting member B' is caused to move by means of the pair of manipulating piece being gripped by one's fingers. At this time, the final engaging projections **8*b*' and 12*b* can be engaged with each other in that the manipulating piece 8'** formed by the resilient frame body is bent, thereby achievement of the final engaging position of the insertion detecting member B' is ensured.

In the construction as shown in FIGS. 7 to 10, 9 manipulating piece 13 having a resilient frame body is provided on both sides of a main frame portion 6' of the insertion detecting member for terminal metal part B1, provisional engaging projections **13*a*, 13*a* on the outside of the upper and lower parts of the free end side are symmetrically formed with respect to the center line L1 of the manipulating piece 13. The final engaging projections 13*b*, 13*b* are symmetrically formed in respect to the center line L1 on the inside of the upper and lower parts which is offset with respect to the main frame portion 6'. A pair of provisional engaging projections 14*a*, 14*a*, which are opposite each other, are formed on the guide rib 12 in the side wall outer surface 14 of the housing body A1'. A columnar final engaging projection 14*b* is provided protrusively on the center line L1 at the middle portion of the pair of guide ribs 12, 12 offset from the step portion A3'. A tapered connecting guide surface 13*a*1 at the front in the direction of travel of the provisional engaging projection 13*a* and a vertical connecting surface 13*a*2 at the rear in the direction of travel of the provisional engaging projection 13*a* are formed. A tapered connecting guide surface 13*b*1 at the front in the direction of travel of the formal engaging projection 13*b* and a tapered connecting surface 13*b*2 at the rear in the direction of travel of the formal engaging projection 13*b* are formed. A tapered connecting guide surface 13*a*2 at the front in the back-and-forth direction of the housing body A1' at the provisional engaging projection 14*a* of the housing body A1' and a vertical engaging surface 14*a*1 at the rear in the back-and-forth direction of the housing body A1' at provisional engaging projection 14*a* of the housing body A1' are formed. Further 13*c*** is a grip on the manipulating portion for grouping by fingers.

In the above constitution, the provisional engaging projections **13*a*, 13*a* of the manipulating piece 13 engage with the provisional engaging projection 14*a*, 14*a* in the provisional engaging condition of the insertion detecting member B1. (referring to FIG. 8**)

In this condition, the insertion detecting the hood portion member B1 is cause to be pulled manually from the window 10 by the manipulating portion **13*c*. At this time, the pair of formal engaging projection 13*b*, 13*b* are permitted to contact with the final engaging projection 14*b* and the pair of final engaging projections 13*b*, 13*b* pass over the final engaging projection 14*b* while deforming themselves in the up-and-down direction and restored to their original state. Thus, the final engaging condition is achieved. (referring to FIG. 9**)

In the above construction, since the pair of provisional engaging projections **13*a*, 13*a* and the final engaging projections 13*b*, 13*b* on the manipulating pieces 13 are provided symmetrically with regard to the respective center lines L1, the movement thereof is stabilized in that the final engaging projections 13*b*, 13*b*** can be moved in an inclined condition.

Figure 10:
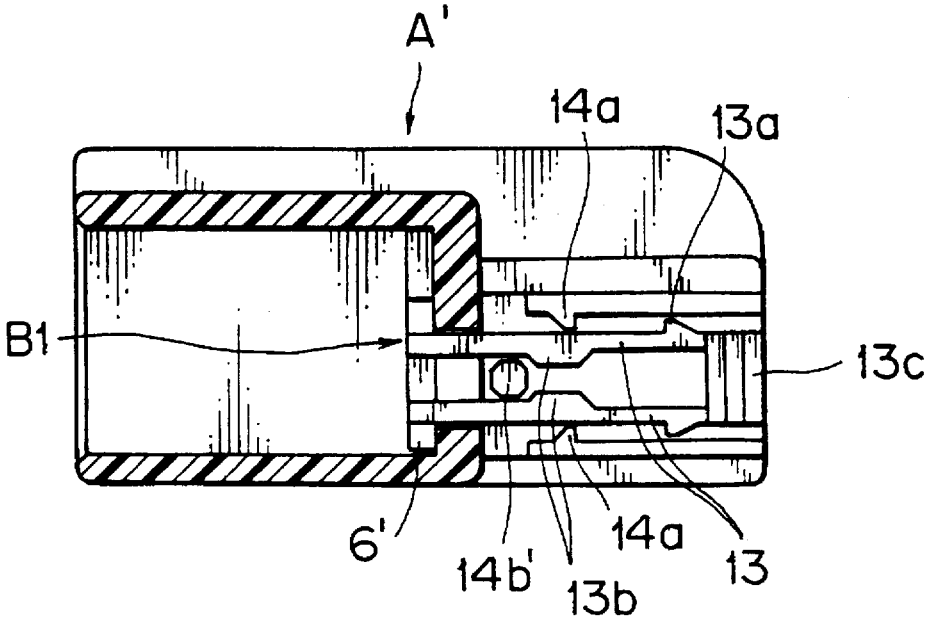
FIG. 10 is a side view showing a final engaging condition according to the third embodiment of the present invention.
Figure 11:
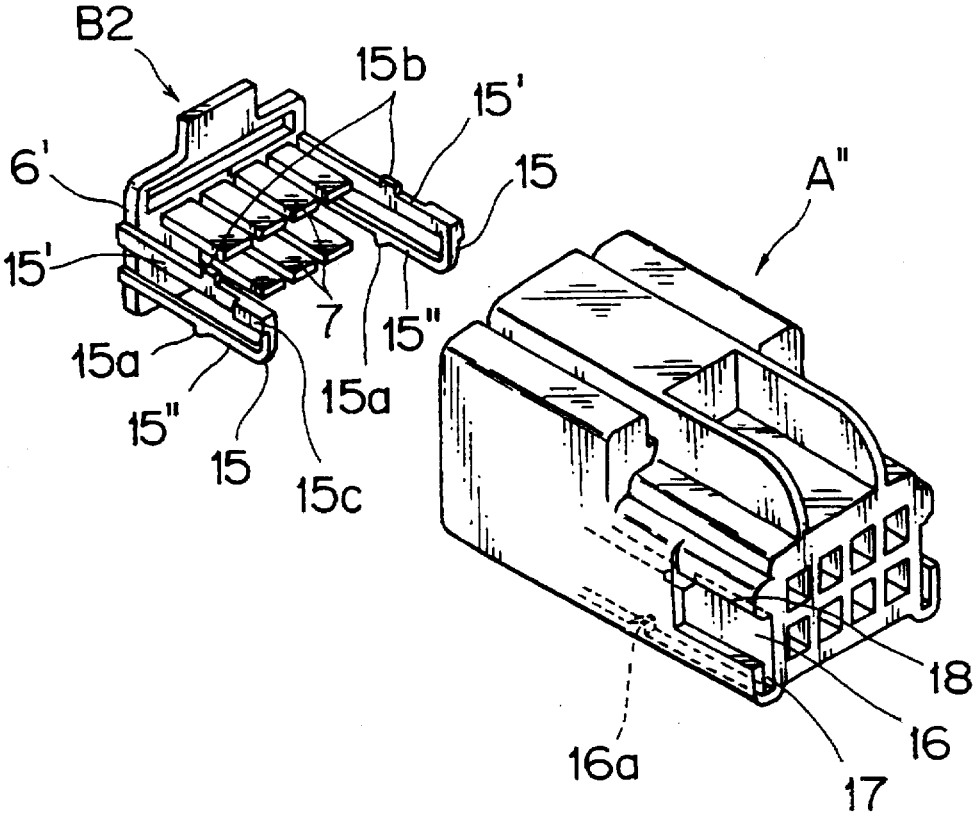
FIG. 11 is a perspective view showing a separated condition between the connector and the insertion detecting member for terminal metal parts according to a fourth embodiment of the present invention.
Figure 12:
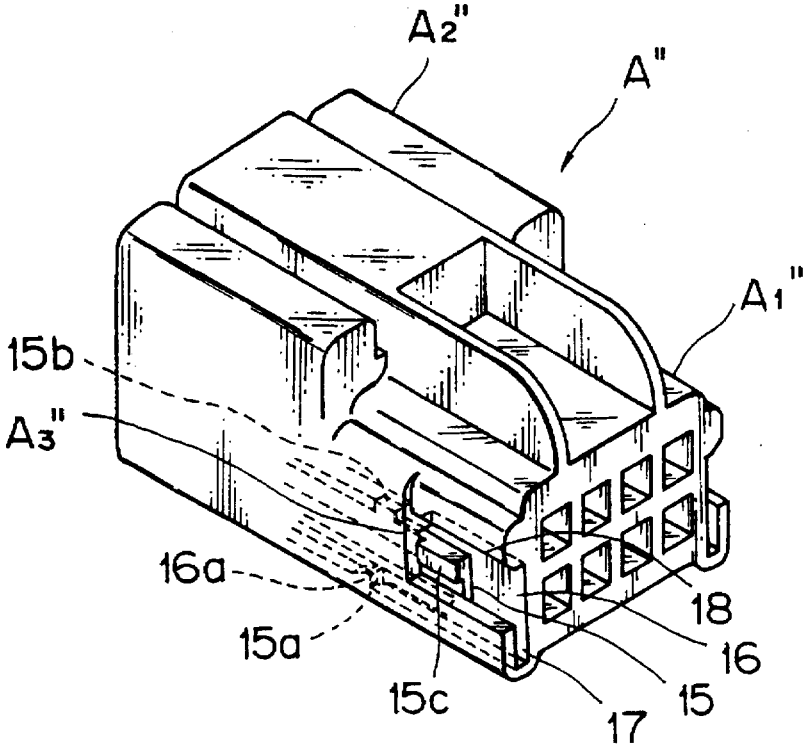
FIG. 12 is a perspective view showing a provisional engaging condition the members shown in of FIG. 11.
Figure 13:
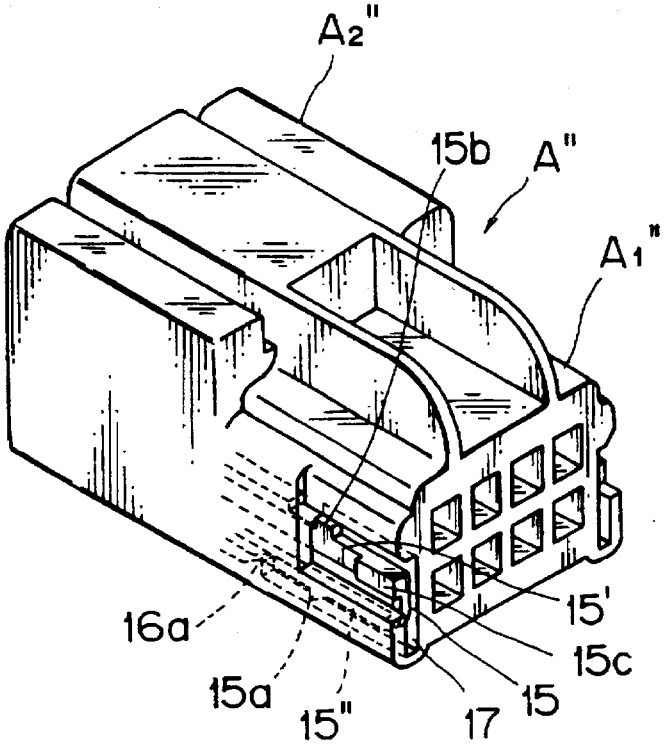
FIG. 13 is a perspective view showing a final engaging condition of the members shown in FIG. 11.
Figure 14:
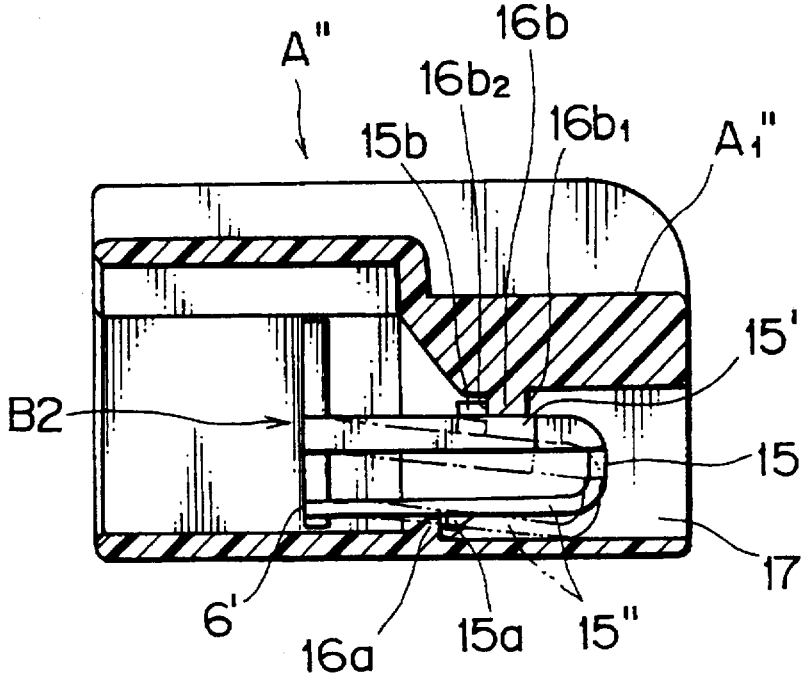
FIG. 14 is a side view showing a provisional engaging condition of the members shown in FIG. 11.
Figure 15:
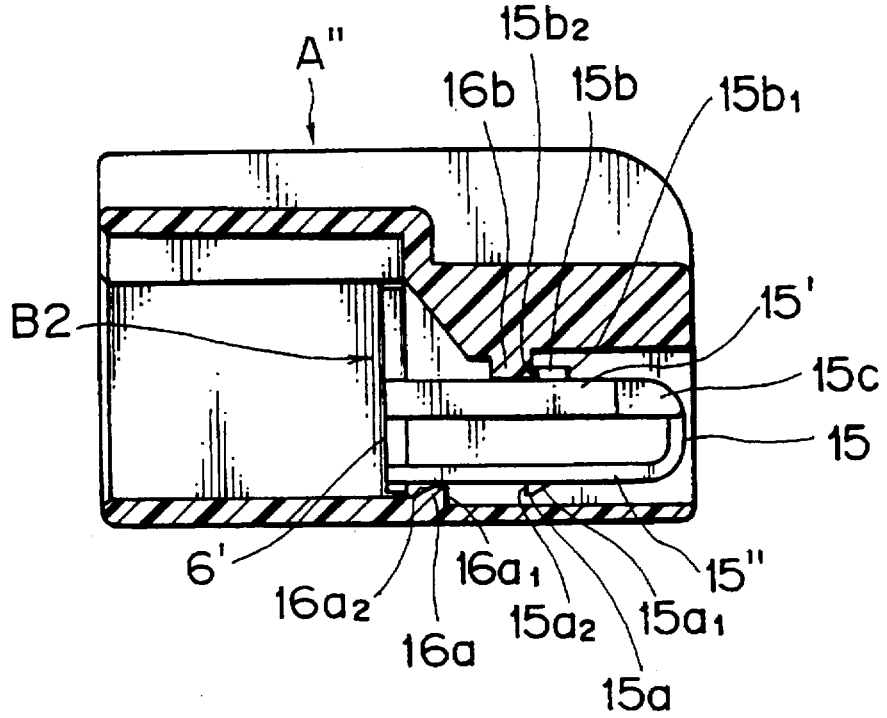
FIG. 15 is a side view showing a final engaging condition of the members shown in FIG. 11.
Figure 16:
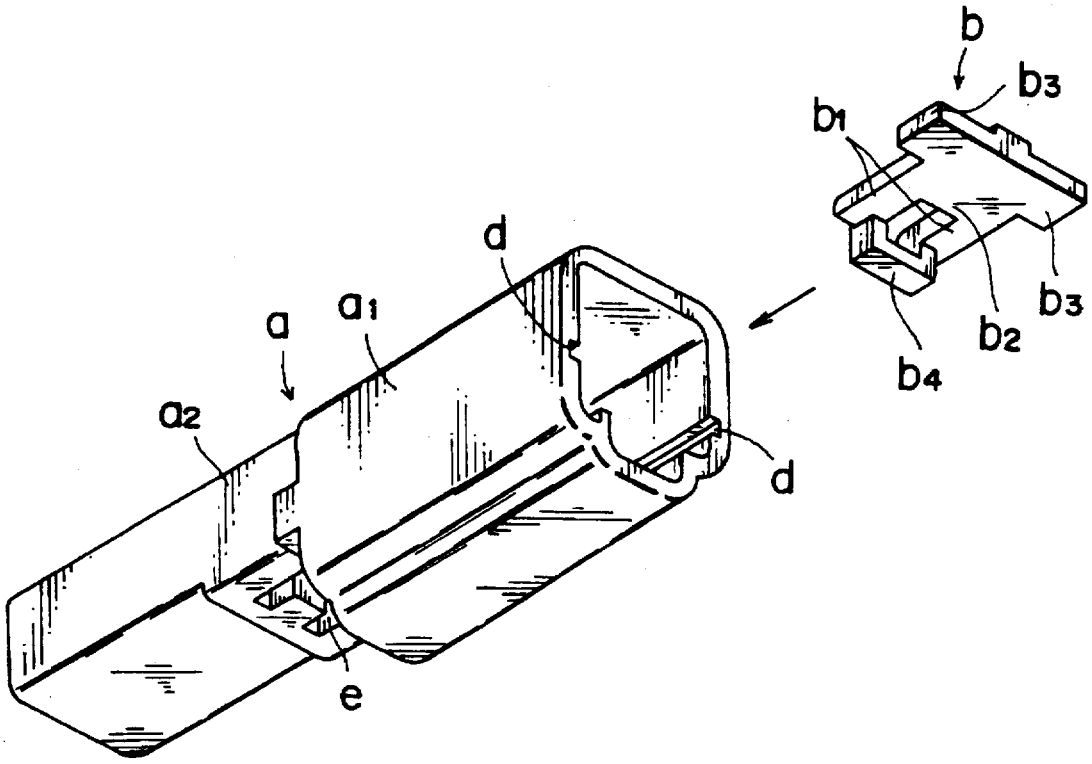
FIG. 16 PRIOR ART
FIG. 16 is a perspective view showing a separated condition between the connector and the insertion detecting member for terminal metal parts according to the conventional embodiment.
Figure 17:
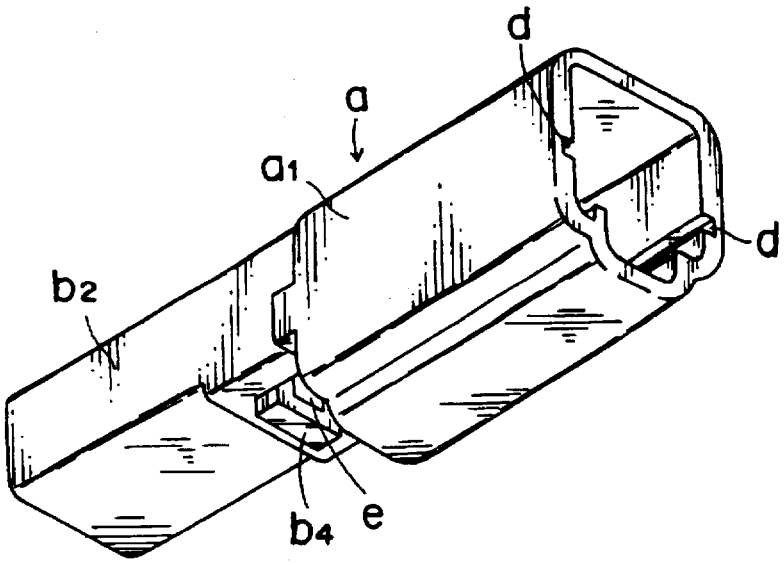
FIG. 17 PRIOR ART
FIG. 17 is a perspective view showing a provisional engaging condition of the members shown in FIG. 16.
Figure 18:
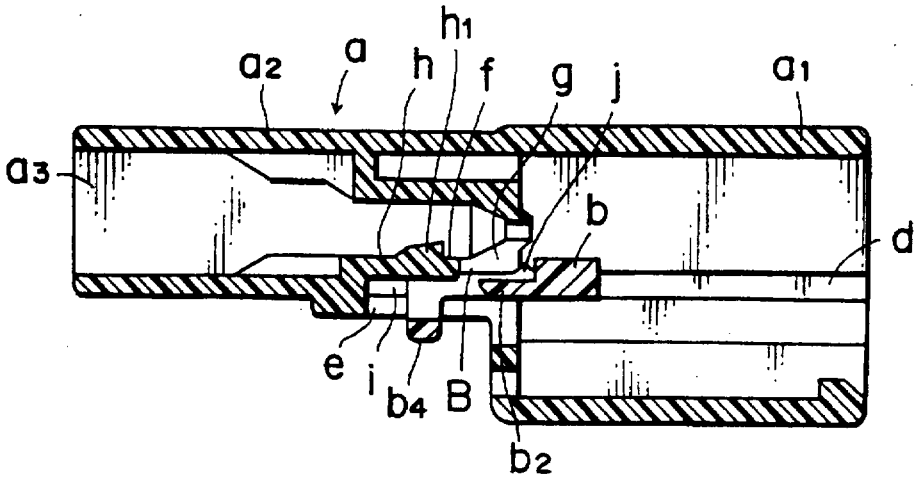
FIG. 18 PRIOR ART
FIG. 18 is a sectional view along an insertion axis direction of FIG. 17.
Figure 19:
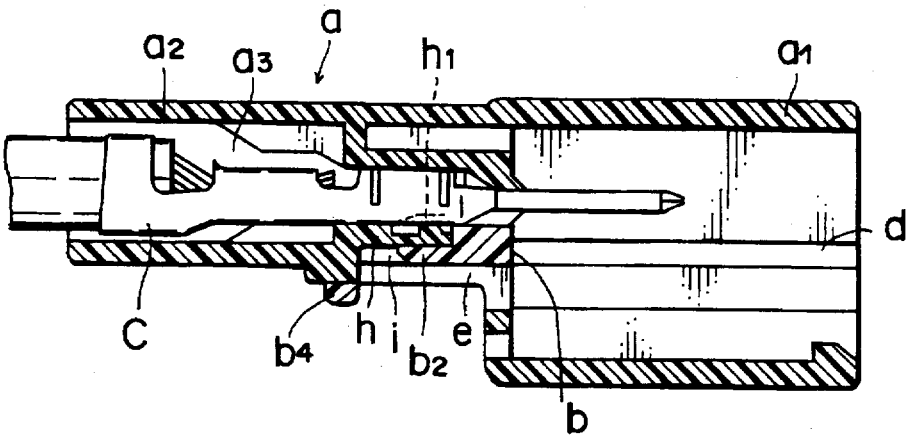
FIG. 19 PRIOR ART
FIG. 19 is a sectional view showing a final engaging condition of the members shown in FIG. 17.
Figure 20:
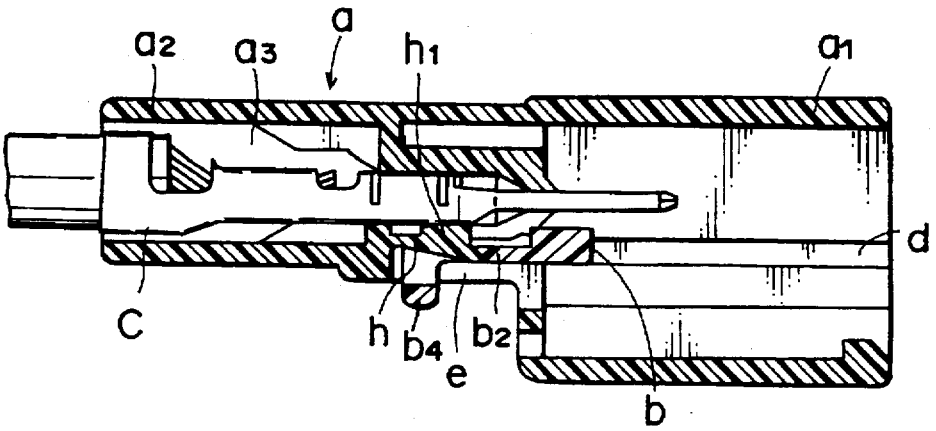
FIG. 20 PRIOR ART
FIG. 20 is a sectional view showing an incomplete insertion condition of the terminal metal parts of FIG. 17.

In the construction shown in FIG. 10, a final engaging projection **14*b*' provided protrusively at the side wall outer surface 14 of the housing body A1' is formed in the shape of an octagonal pillar. The angle of the taper of the tapered engaging guide surface 13*b*1 at the final engaging projection 13*b*** of the insertion detecting member B1 can be properly set by a selected insertion force and an insertion feeling can be obtained.

In the construction shown in FIGS. 11 to 15, the manipulating piece 15 of the frame body is provided on both sides of the main frame portion 6' of the insertion detecting member B2 for terminal metal part C. The manipulating piece 15 has a rigid frame portion 15' at the upper part and a resilient displacement frame portion 15" at the lower part. A provisional engaging projection **15*a* is formed at the outer side of the resilient displacement frame portion 15". A final engaging projection 15*b* is formed at the outer side of the rigid frame portion. A provisional engaging projection 16*a* is formed in the supporting groove 17 extending back-and-forth at the lower part of the side wall outer surface 16 of the housing body A1 of the female connector A". The final engaging projection 16*b* is formed at the step portion 18 provided opposite to the supporting groove 17** on the inside the of upper part of the side wall outer surface.

In the insertion detecting member B2, a tapered connecting guide surface **15*a*1 at the front in the direction of travel of the provisional engaging projection 15*a* and a vertical connecting surface 15*a*2 at the rear in the direction of travel of the provisional engaging projection 15*a* are formed. Vertical connecting surfaces 15*b*1, 15*b*2 are formed at the front and the rear of the final engaging projection 15*b***, respectively.

A tapered connecting guide surface **16*a*2 at the front in the direction of back-and-forth of the housing body A1" at the provisional engaging projection 16*a* of the housing body A1" and a vertical engaging surface 16*a*1 at the rear in the direction of back-and-forth of the housing body A1" at provisional engaging projection 16*a* of the housing body A" are formed. Vertical connecting surfaces 16*b*1, 16*b*2 are formed at the front and the rear of the final engaging projection 16*b*, respectively. A manipulating portion for grasping 15*c* is formed at the end portion of the rigid frame portion 15**.

In the above described constitution, at the provisional engaging condition of the insertion detecting member B2, the provisional engaging projection 15*a* of the resilient displacement frame portion 15" exposed at the side wall outer surface 16 from the window 10 of the step portion A3" and the hood portion A2" engages with the vertical connecting surface 16*a*1 of the provisional engaging projection 16*a* of the housing body A1. The final engaging projection 15*b* of the rigid frame portion 15' engages with the vertical connecting surface 16*b*1 of the final engaging projection 16*b* of the housing body A1". (referring to FIGS. 12 and 14)

The manipulating piece 15 is caused to pull out when it is pushed downward manually by the manipulating portion 15*c* at this time. The final engaging projections 15*b* pass over the formal engaging projections 16*b* in that the resilient displacement frame portion 15" is deformed without difficulty by depression. When the depression is removed the final engaging projection 15*b* is restored to its original state, and is engaged with the vertical connecting surface 16*b*2. Thus, the final engaging condition is produced. (referring to FIGS. 13 and 15)

In the above described construction, there is provided the rigid frame portion and resilient displacement frame portion for the frame-shape manipulating piece, the final engaging projection is provided for the rigid frame portion so that it ensures the engagement operation, and the movement from the provisional engaging position to the final engaging position by means of resilient displacement frame portion is facilitated.

As described above, according to the present invention there are provided a connector equipped with a hood portion in the front thereof, and an insertion detecting member for terminal metal parts provided movably from the provisional engaging position to the final engaging position in the hood portion. The resilient engaging piece to the terminal metal part is moved into the resilient displacement permissible space opposite the terminal accommodating cavity formed in the connector body portion of the connector. There are provided the insertion detecting body corresponding in shape to the resilient displacement permissible space at the main frame portion of the insertion detecting member for terminal metal part and the pair of manipulating pieces at both sides thereof. The insertion detecting member for terminal metal parts is caused to have the main frame portion come into contact with the inside wall surface of the hood portion, moving freely. The pair of manipulating pieces are exposed on both sides of the housing body portion extending from the window of the hood portion at the provisional engaging position, the insertion detecting body enters into the resilient displacement permissible space at the final engaging position, therefore it is not necessary to enlarge the housing to maintain the strength of the hood portion. The insertion detecting member for terminal metal parts is also capable of being moved within the hood portion, and the insertion detecting member for terminal metal parts of the provisional engaging position can move smoothly toward the final engaging position being moved by pair of the manipulating portions.

What is claimed is:

1. A connector equipped with an insertion detecting member for terminal metal parts, comprising:

a connector housing having a housing body portion and containing walls defining a hood portion disposed adjacent said housing body portion and communicating therewith, the walls of said hood portion having greater peripheral dimensions than said housing body portion and being interconnected therewith on laterally opposite sides of said housing body portion by a step portion containing a window;

said housing body portion containing at least one terminal accommodating cavity and at least one resilient displacement permissible space, and a resilient engaging piece separating said terminal accommodating cavity from said resilient displacement permissible space, an insertion detecting member for terminal metal parts installed in said connector housing hood portion and movable therein from a provisional engaging position to a final engaging position, said insertion detecting member having a main frame portion and an insertion detecting body, said insertion detecting body corresponding in number of and in shape to said resilient displacement permissible space, a pair of manipulating pieces disposed each on opposite sides of said insertion detecting body and arranged to have ends extending to an exposed position through said windows in said connector housing step portion, with said main frame portion of said insertion detecting member in contact with an inside wall surface of said hood portion; and means for grasping the exposed ends of said manipulating pieces for freely moving said insertion detecting member from a provisional engaging position within said connector housing hood portion to a final engaging position in which said insertion detecting body enters the associated resilient displacement permissible space.

2. A connector equipped with an insertion detecting member for terminal metal parts according to claim 1, including cooperating stop means on said insertion detecting member and said connector housing effecting a provisional engagement and a final engagement between said insertion detecting member and said connector housing.

3. A connector equipped with an insertion detecting member for terminal metal parts according to claim 2, wherein said manipulating piece comprises a frame body which is composed of a rigid frame portion and a resilient displaceable frame portion, cooperating projections on said manipulating pieces and said housing body portion for effecting a provisional engaging and a final engaging between said manipulating piece and said housing body portion, said final engaging projection is provided on said rigid frame portion of said manipulating pieces.

4. A connector equipped with an insertion detecting member for terminal metal parts according to claim 2, wherein each of said manipulating pieces has a resilient body, and cooperating stop means on said manipulating pieces and said housing body portion effecting a provisional engagement and a final engagement between said manipulating pieces and said housing body portion.

5. A connector equipped with an insertion detecting member for terminal metal parts according to claim 4, wherein each of said manipulation pieces has a resilient frame body, and stop means on a pair of provisional engaging projections and a pair of final engaging projections provided symmetrically on said resilient frame body for engagement.

6. A connector equipped with an insertion detecting member for terminal metal parts according to claim 5, wherein said pair of final engaging projections are provided oppositely to each other on the inside of said resilient frame body and a final engaging projection on said housing body portion is positioned intermediate said pair of final engaging projections.

7. A connector equipped with an insertion detecting member for terminal metal parts according to claim 6, wherein said final engaging projection on said housing body portion is an octagonal pillar.

* * * * *